US005936606A

United States Patent [19]

Lie

[11] Patent Number: 5,936,606

[45] Date of Patent: Aug. 10, 1999

[54] ON-SCREEN EDIT/DISPLAY CONTROLLER

[75] Inventor: Ching-Sheng Lie, Hsinchu, Taiwan

[73] Assignee: Winbond Electronics Corp., Taiwan

[21] Appl. No.: 08/632,554

[22] Filed: Apr. 15, 1996

[51] Int. Cl.[6] ..... G09G 5/00

[52] U.S. Cl. ..... 345/113; 345/114; 345/435

[58] Field of Search ..... 345/112, 113, 345/114, 115, 435, 344, 144, 118

[56] References Cited

U.S. PATENT DOCUMENTS

| | | | |
|---|---|---|---|
| 5,093,798 | 3/1992 | Kita | 345/113 |
| 5,146,592 | 9/1992 | Pfeiffer et al. | 345/344 |
| 5,444,835 | 8/1995 | Turkowski | 345/435 |
| 5,625,374 | 4/1997 | Turkowski | 345/113 |
| 5,633,654 | 5/1997 | Kennedy, Jr. et al. | 345/114 |

*Primary Examiner*—Richard A. Hjerpe
*Assistant Examiner*—Kent C Lang
*Attorney, Agent, or Firm*—Christie, Parker & Hale, LLP

[57] ABSTRACT

An on-screen edit/display controller has an input unit which is adapted to receive overlaying input data that includes a region header and overlaying image data. The region header defines the location and size of a user-defined region of a display, while the overlaying image data includes mixing weight data and pixel data of a user-defined overlaying image. A mixing unit is adapted to receive pixel data of an original image from an external data source and the overlaying image data from the input unit. The mixing unit is operable in a normal mode, wherein the mixing unit outputs the pixel data of the original image, and a mixing mode, wherein the mixing unit outputs the sum of the product of the pixel data of the overlaying image and a first mixing ratio, and the product of the pixel data of the original image and a second mixing ratio. The sum of the first mixing ratio, which corresponds to the mixing weight data and which ranges from 0 to 1, and the second mixing ratio is equal to 1. An output control unit receives the region header from the input unit and controls the mixing unit to operate in the normal mode when a portion of the display which is outside the user-defined region is being scanned, and in the mixing mode when the user-defined region is being scanned.

15 Claims, 13 Drawing Sheets

| bitmap data | color table |
|---|---|
| 00 | palette 1 |
| 01 | palette 2 |
| 10 | palette 3 |
| 11 | palette 4 |

FIG. 8

| bitmap data | color table |
|---|---|
| 0000 | palette 1 |
| 0001 | palette 2 |
| 0010 | palette 3 |
| . | . |
| . | . |
| . | . |
| . | . |
| . | . |
| 1110 | palette 15 |
| 1111 | palette 16 |

FIG. 9

| mix weight | SEL[1:0] | SEL 2 | SEL 3 | SEL 4 |
|---|---|---|---|---|
| 0 | 00 | 0 | 0 | 0 |
| 1 | 01 | 0 | 0 | 0 |
| 2 | 00 | 1 | 0 | 0 |
| 3 | 01 | 1 | 0 | 0 |
| 4 | 00 | 0 | 0 | 1 |
| 5 | 01 | 0 | 0 | 1 |
| 6 | 00 | 1 | 0 | 1 |
| 7 | 01 | 1 | 0 | 1 |
| 8 | 00 | 0 | 1 | 0 |
| 9 | 01 | 0 | 1 | 0 |
| 10 | 00 | 1 | 1 | 0 |
| 11 | 01 | 1 | 1 | 0 |
| 12 | 00 | 0 | 1 | 1 |
| 13 | 01 | 0 | 1 | 1 |
| 14 | 00 | 1 | 1 | 1 |
| 15 | 01 | 1 | 1 | 1 |
| 16 | 10 | 0 | 0 | 0 |

FIG. 11

| mix ratio | split into parts | accumulation |
|---|---|---|
| 1/16 | | A[7:4] |
| 2/16 | | A[7:3] |
| 3/16 | 1/16 + 2/16 | A[7:4]+A[7:3] |
| 4/16 | | A[7:2] |
| 5/16 | 1/16 + 4/16 | A[7:4] + A[7:2] |
| 6/16 | 2/16 + 4/16 | A[7:3] + A[7:2] |
| 7/16 | 1/16+2/16+4/16 | A[7:4] + A[7:3] + A[7:2] |
| 8/16 | | A[7:1] |
| 9/16 | 1/16 + 8/16 | A[7:4] + A[7:1] |
| 10/16 | 2/16 + 8/16 | A[7:3] + A[7:1] |
| 11/16 | 1/16+2/16+8/16 | A[7:4] + A[7:3] + A[7:1] |
| 12/16 | 4/16 + 8/16 | A[7:2] + A[7:1] |
| 13/16 | 1/16+4/16+8/16 | A[7:4] + A[7:2] + A[7:1] |
| 14/16 | 2/16+4/16+8/16 | A[7:3] + A[7:2] + A[7:1] |
| 15/16 | 1/16+2/16+4/16+ 8/16 | A[7:4] + A[7:3] + A[7:2] + A[7:1] |

FIG.14 idle: initial idle state
state 1: read region header
state 2: read color table 1,2,3,4
state 3: read color table 5,...,16
state 4: read bitmap data when region active

ON-SCREEN EDIT/DISPLAY CONTROLLER

BACKGROUND OF THE INVENTION

1. Field of the Invention

The invention relates to a display controller, more particularly to an on-screen edit/display controller which permits overlaying of user-defined images at user-defined regions of a display.

2. Description of the Related Art

Conventionally, an image is overlaid at a region of a display in the following manner: A read only memory (ROM) is used to store a fixed image which is to be overlaid at a fixed region of the display. When scanning of the display reaches the fixed region, the contents of the ROM are retrieved so as to replace the original image. Therefore, in the conventional overlaying procedure, only fixed images which are stored previously in the ROM can be overlaid at fixed regions of the display.

SUMMARY OF THE INVENTION

The main object of the present invention is to provide an on-screen edit/display controller which permits overlaying of at least one user-defined image on a display.

Another object of the present invention is to provide an on-screen edit/display controller with overlaying input data that has a smaller data size as compared to the prior art.

Another object of the present invention is to provide an on-screen edit/display controller which permits overlaying of the user-defined image at a user-defined region of the display.

Still another object of the present invention is to provide an on-screen edit/display controller which permits overlaying of the user-defined image on the entire display.

A further object of the present invention is to provide an on-screen edit/display controller which is capable of mixing the user-defined image and the original image and which permits replacement of the original image with the user-defined image at the user-defined region of the display.

Accordingly, the on-screen edit/display controller of the present invention comprises:

an input unit which is adapted to receive overlaying input data that includes a region header and overlaying image data, the region header defining location and size of a user-defined region of a display, the overlaying image data including mixing weight data and pixel data of a user-defined overlaying image;

a mixing unit, connected electrically to the input unit, which is adapted to receive pixel data of an original image from an external data source and the overlaying image data from the input unit, the mixing unit being operable in a normal mode, wherein the mixing unit outputs the pixel data of the original image, and a mixing mode, wherein the mixing unit outputs the sum of the product of the pixel data of the overlaying image and a first mixing ratio, and the product of the pixel data of the original image and a second mixing ratio, the first mixing ratio corresponding to the mixing weight data and ranging from 0 to 1, the first and second mixing ratios having a sum equal to 1; and an output control unit connected electrically to the input unit and the mixing unit, the output control unit receiving the region header from the input unit and controlling the mixing unit to operate in the normal mode when a portion of the display which is outside the user-defined region is being scanned, and in the mixing mode when the user-defined region is being scanned.

Preferably, the input unit comprises a first-in first-out memory for storing the overlaying input data therein, a memory controller for controlling reading and writing operations of the memory, and a data parsing unit for distributing data from the memory to the mixing unit and the output control unit.

The pixel data of the overlaying image includes a color map table having a predetermined number of color palette components, and a plurality of bitmap data, each of which corresponds to one pixel of the overlaying image and indicates the color palette component that corresponds to the respective pixel of the overlaying image.

A data processing unit interconnects electrically the data parsing unit with the mixing unit and the output control unit, and includes:

a color map register which receives the color map table from the data parsing unit and which stores the color map table therein;

a bitmap conversion unit which receives the bitmap data from the data parsing unit and which is connected electrically to the color map register, the bitmap conversion unit converting the bitmap data into the corresponding color palette components and providing the corresponding color palette components to the mixing unit;

a mixing weight register which receives the mixing weight data from the data parsing unit and which stores the mixing weight data therein, the mixing weight register providing the mixing weight data to the mixing unit; and a region header register which receives the region header from the data parsing unit and which stores the region header therein, the region header register providing the region header to the output control unit.

Moreover, an operation state controller is connected electrically to the memory controller and the data parsing unit of the input unit and to the output control unit. The operation state controller is activated by the output control unit so as to control in turn the memory controller to commence the reading and writing operations of the memory and so as to further control the data parsing unit to distribute the data from the memory to the data processing unit when the user-defined region is being scanned. The operation state controller is deactivated by the output control unit when the portion of the display which is outside the user-defined region is being scanned.

BRIEF DESCRIPTION OF THE DRAWINGS

Other features and advantages of the present invention will become apparent in the following detailed description of the preferred embodiment with reference to the accompanying drawings, of which:

FIG. 8 shows a table which illustrates the relationship between bitmap data of the overlaying input data shown in FIG. 2 and the color map table of FIG. 5;

FIG. 9 shows a table which illustrates the relationship between bitmap data of the overlaying input data shown in FIG. 2 and the color map table of FIG. 6;

FIG. 11 illustrates a truth table of a combinal logic of the mix controller shown in FIG. 10;

FIG. 14 is a table which illustrates operation of the accumulator shown in FIG. 13;

DETAILED DESCRIPTION OF THE PREFERRED EMBODIMENT

Figure 1:
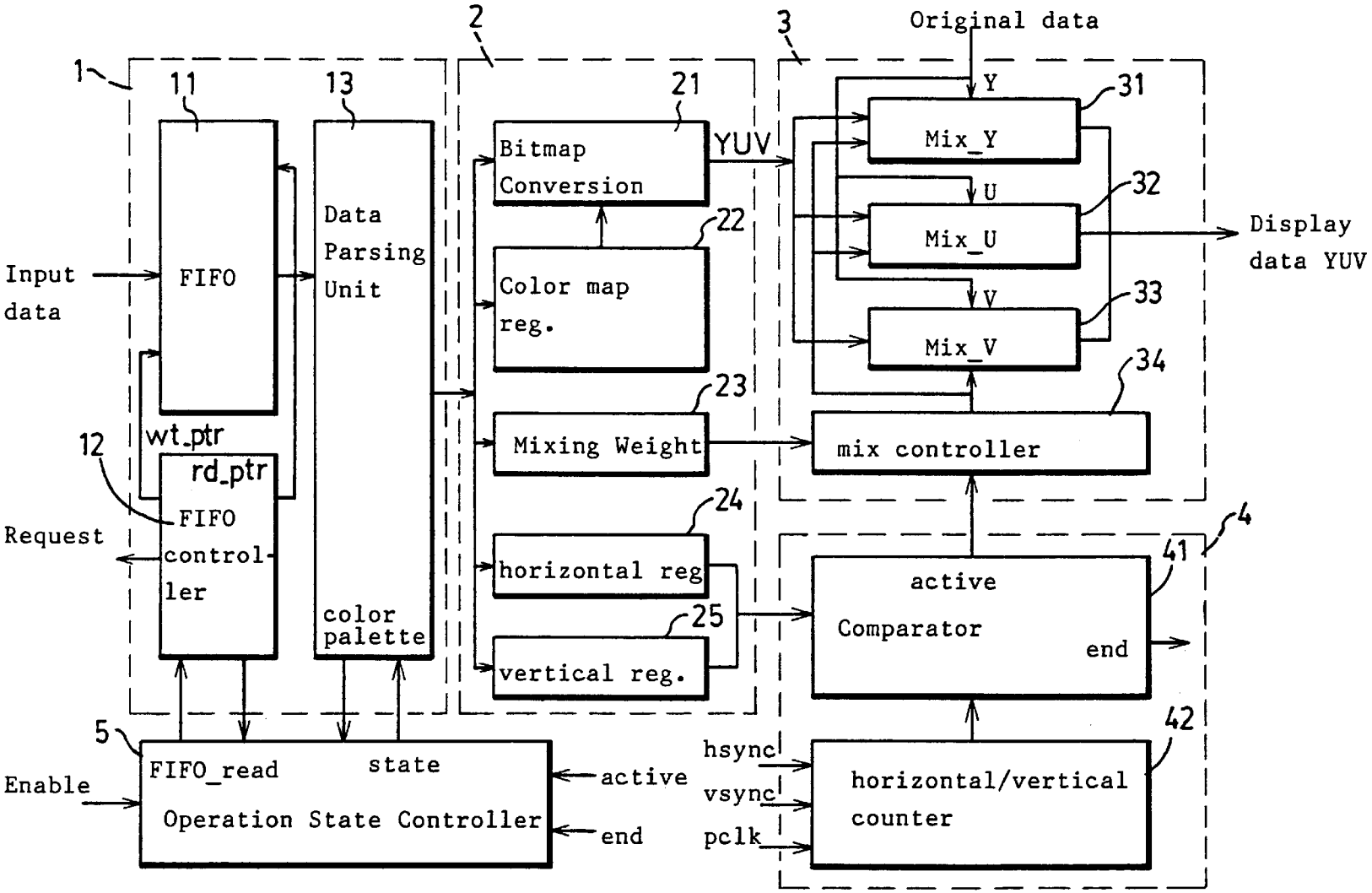
FIG. 1 is a schematic circuit block diagram of the preferred embodiment of an on-screen edit/display controller according to the present invention.

Referring to FIG. 1, the preferred embodiment of an on-screen edit/display controller according to the present invention is shown to comprise an input unit 1, a data processing unit 2, a mixing unit 3, an output control unit 4 and an operation state controller 5.

The input unit 1 receives overlaying input data from an external data source. The overlaying input data, which is user-defined, includes a region header for defining the location and size of a user-defined region of a display, and overlaying image data of a user-defined image that is to be overlaid at the user-defined region. The data processing unit 2 retrieves the overlaying input data from the input unit 1, and distributes the same to the mixing unit 3 and the output control unit 4. The mixing unit 3 receives pixel data of the original image and mixes the same with the overlaying image data from the data processing unit 2. The output of the mixing unit 3 is then provided to the display. The output control unit 4 receives the region header and activates the mixing unit 3 to output the pixel data of the original image when a portion of the display which is outside the user-defined region is being scanned, and to output the mixture of the pixel data of the original image and the overlaying image data when the user-defined region is being scanned. The operation state controller 5 controls the transfer of the overlaying input data to and from the input unit 1.

The input unit 1 includes a first-in first-out (FIFO) memory 11, a FIFO memory controller 12 and a data parsing unit 13. The FIFO memory 11 receives the overlaying input data which correspond to the user-defined images that are to be overlaid at the user-defined regions of a display. When enabled, the FIFO memory controller 12 generates a Request signal to commence the transfer of the overlaying input data to the FIFO memory 11. The FIFO memory controller 12 is also responsible for controlling the reading and writing operations of the FIFO memory 11. This is done by moving the read and write pointers rd-ptr, wt-ptr during the reading and writing operations in a known manner. The data parsing unit 13 receives the data which were read from the FIFO memory 11, and provides the same to the data processing unit 2.

Figure 2:
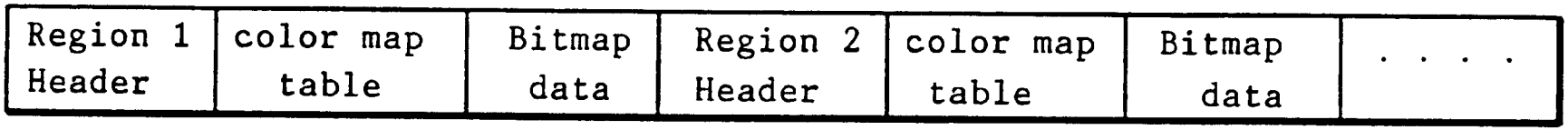
FIG. 2 illustrates the format of overlaying input data to the preferred embodiment.

FIG. 2 illustrates the format of the overlaying input data that is supplied to FIFO memory 11. As shown, the overlaying input data for each user-defined image includes the region header and the overlaying image data which includes mixing weight data and pixel data of the user-defined overlaying image. The pixel data is in the form of a color map table and bitmap data.

Figure 3:
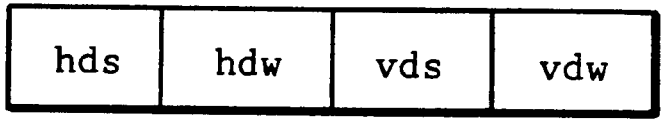
FIG. 3 illustrates the data which constitute a region header of the overlaying input data shown in FIG. 2.
Figure 4:
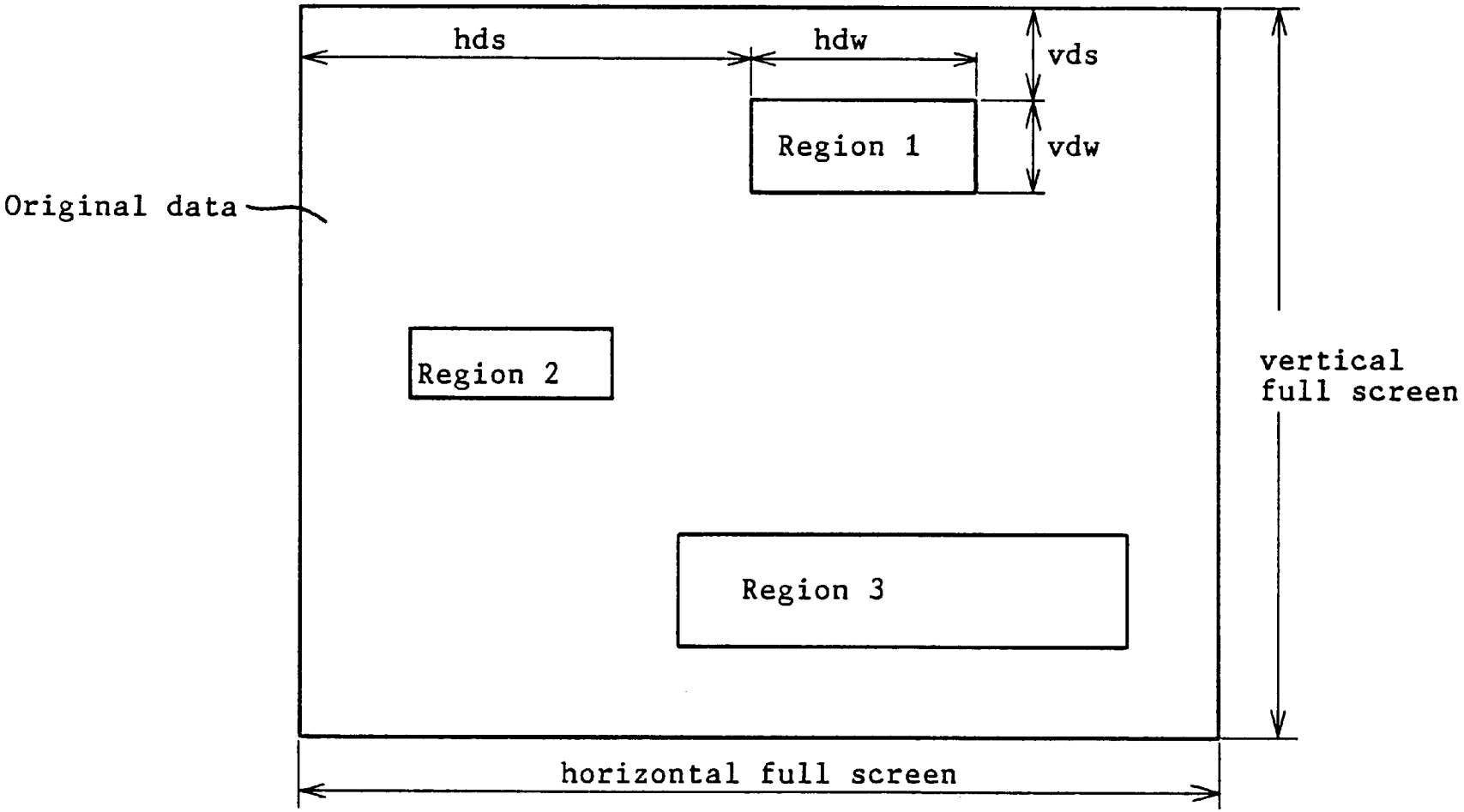
FIG. 4 illustrates a display with three user-defined regions to be overlaid in accordance with the on-screen edit/display controller of the present invention.

Referring to FIGS. 3 and 4, the region header includes the starting address (hds) of the user-defined display region in the horizontal direction, the horizontal width (hdw) of the user-defined display region, the starting address (vds) of the user-defined display region in the vertical direction, and the vertical width (vdw) of the user-defined display region.

Figure 5:
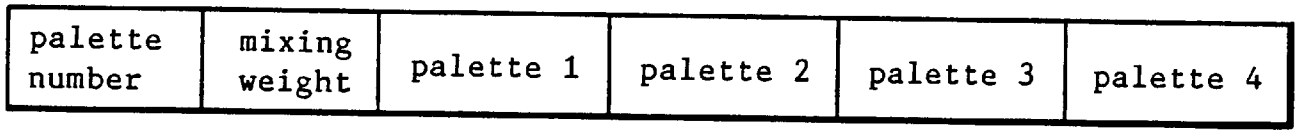
FIG. 5 illustrates a first example of a color map table for the overlaying input data shown in FIG. 2.
Figure 6:
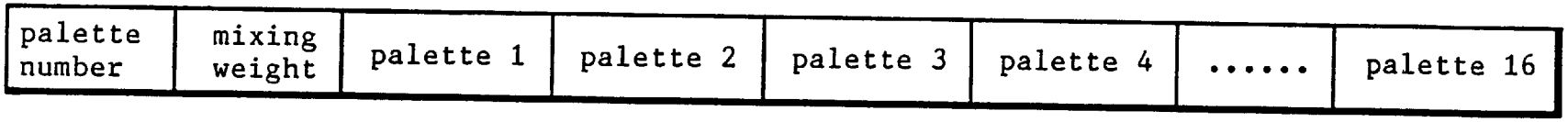
FIG. 6 illustrates a second example of a color map table for the overlaying input data shown in FIG. 2.
Figure 7:
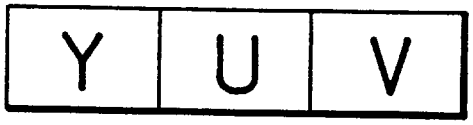
FIG. 7 illustrates the data which constitute a color palette component of the color map tables shown in FIGS. 5 and 6.

Referring to FIGS. 5 and 6, the color map table includes the number of available color palette components, the mixing weight used in the mixing of the pixel data of the user-defined image and the original image, and the color palette components. In this embodiment, there are two types of color map tables that may be used. The color map table shown in FIG. 5 has four available color palette components, whereas the color map table shown in FIG. 6 has sixteen available color palette components. As shown in FIG. 7, each color palette component includes an 8-bit luminance component (Y) and 8-bit chrominance components (U), (V). Alternatively, each color palette component may include R, G and B color components.

In this embodiment, the mixing weight is a number from 0 to 16. When the mixing weight is divided by the number 16, a first mixing ratio is thus obtained. A second mixing ratio is obtained by subtracting the first mixing ratio from the number 1. Referring once more to FIG. 4, the original image is shown outside the user-defined regions of the display. However, inside the user-defined regions, the image that is presented is a mixture of the original image and the user-defined image. The images inside the user-defined regions are obtained by multiplying the pixel data of the user-defined images by the first mixing ratio and the pixel data of the original images with the second mixing ratio, and by adding the resulting products. Thus, a mixing weight of 16 means that the user-defined image replaces the original image in the user-defined region, whilst a mixing weight of 7 means that the display data in the user-defined region comprises seven-sixteenths of the overlaying pixel data and nine-sixteenths of the original pixel data.

FIGS. 8 and 9 illustrate the relationship between each bitmap data and the color palette components. Each bitmap data may have two or four data bits. Specifically, each bitmap data has two data bits if there are only four available color palette components (see FIG. 8), and four data bits if otherwise, i.e. there are sixteen available color components (see FIG. 9). As shown in FIG. 8, the data bits 00, 01, 10, 11 correspond to the color palette components 1 to 4, respectively. In FIG. 9, the data bits 0000 to 1111 correspond to the color palette components 1 to 16, respectively. Thus, the bitmap data of FIG. 8 requires only two data bits to represent one pixel of the user-defined display region. Although the bitmap data of FIG. 9 requires a greater number of data bits, thereby resulting in a larger data size, a higher degree of resolution can be obtained.

Referring once more to FIG. 1, the data processing unit 2 includes a bitmap conversion unit 21, a color map register 22, a mixing weight register 23, a horizontal address register 24 and a vertical address register 25. The horizontal address register 24 stores the starting address (hds) and the horizontal width (hdw) from the data parsing unit 13 therein, the vertical address register 25 stores the starting address (vds) and the vertical width (vdw) from the data parsing unit 13 therein, and the mixing weight register 23 stores the mixing weight from the data parsing unit 13 therein. The color map register 22 includes sixteen register units (not shown) and are used to store the color palette components 1 to 16 from the data parsing unit 13 therein. However, if there are only four available color palette components, the latter twelve of the register units are not used. The bitmap conversion unit 21 receives the bitmap data from the data parsing unit 13 and converts the bitmap data into the corresponding color palette components.

The mixing unit 3 includes first, second and third mixers 31, 32, 33, and a mix controller 34 for controlling the mixing operations of the mixers 31, 32, 33.

Figure 10:
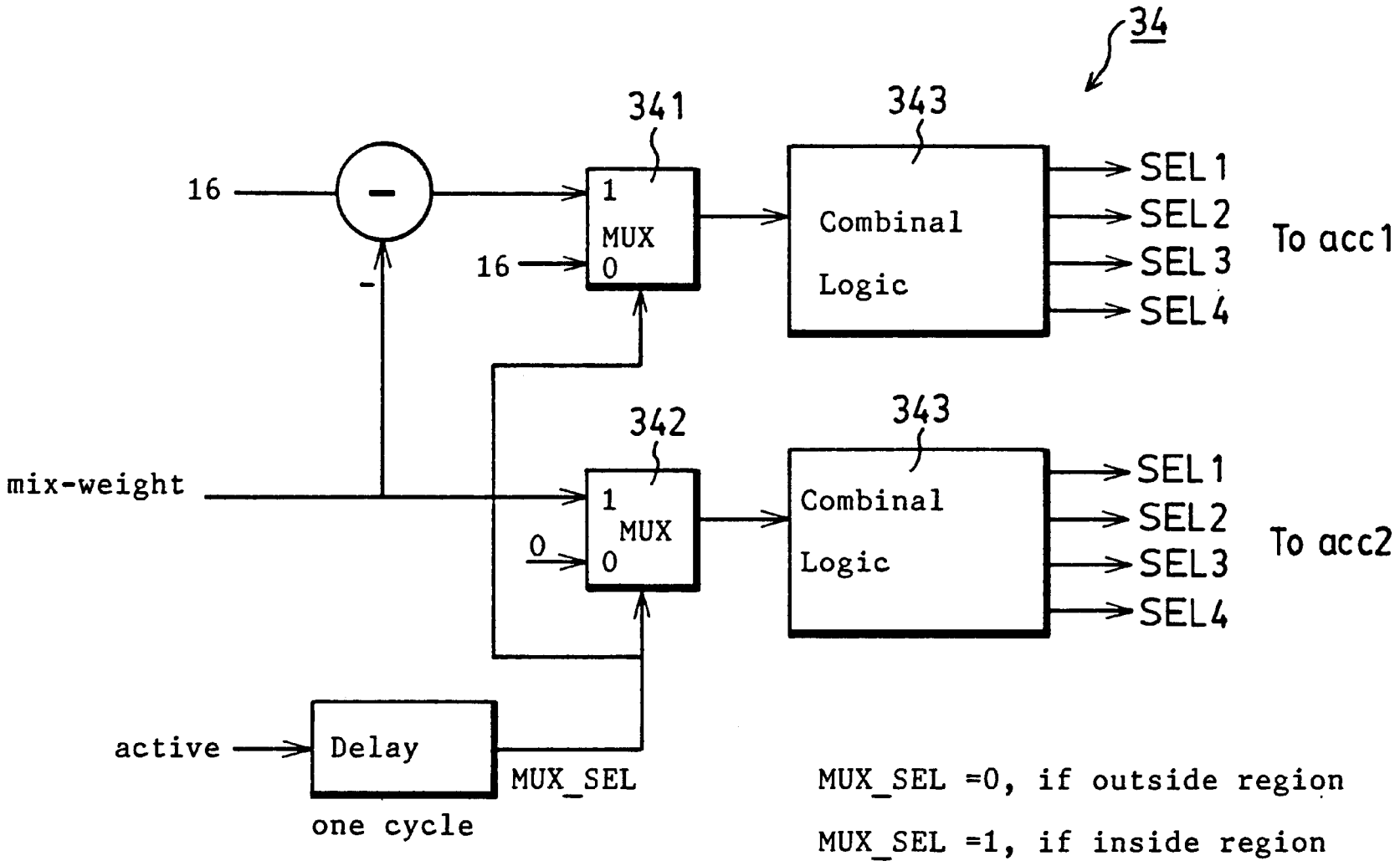
FIG. 10 is a schematic circuit block diagram of a mix controller of a mixing unit of the preferred embodiment.

Referring to FIG. 10, the mix controller 34 includes first and second multiplexers 341, 342, and two combinal logic circuits 343. The first multiplexer 341 has a first input which receives the value of sixteen less the mixing weight, and a second input which receives the value 16. The second multiplexer 342 has a first input which receives the mixing weight from the mixing weight register 23 (see FIG. 1), and a second input which receives the value 0. The first and second multiplexers 341, 342 select the respective first input when the user-defined region is being scanned. Each of the combinal logic circuits 343, which are identical in construction, generates four select signals SEL1, SEL2, SEL3, SEL4 that are used to control the operations of the mixers 31, 32, 33. The truth table of each combinal logic circuit 343 is shown in FIG. 11.

The first mixer 31 mixes the luminance components (Y) of the original pixel data and the overlaying pixel data, the second mixer 32 mixes the chrominance components (U) of the original pixel data and the overlaying pixel data, while the third mixer 33 mixes the chrominance components (V) of the original pixel data and the overlaying pixel data. Since the three mixers 31, 32, 33 are identical in construction, only the first mixer 31 will be described herein.

Figure 12:
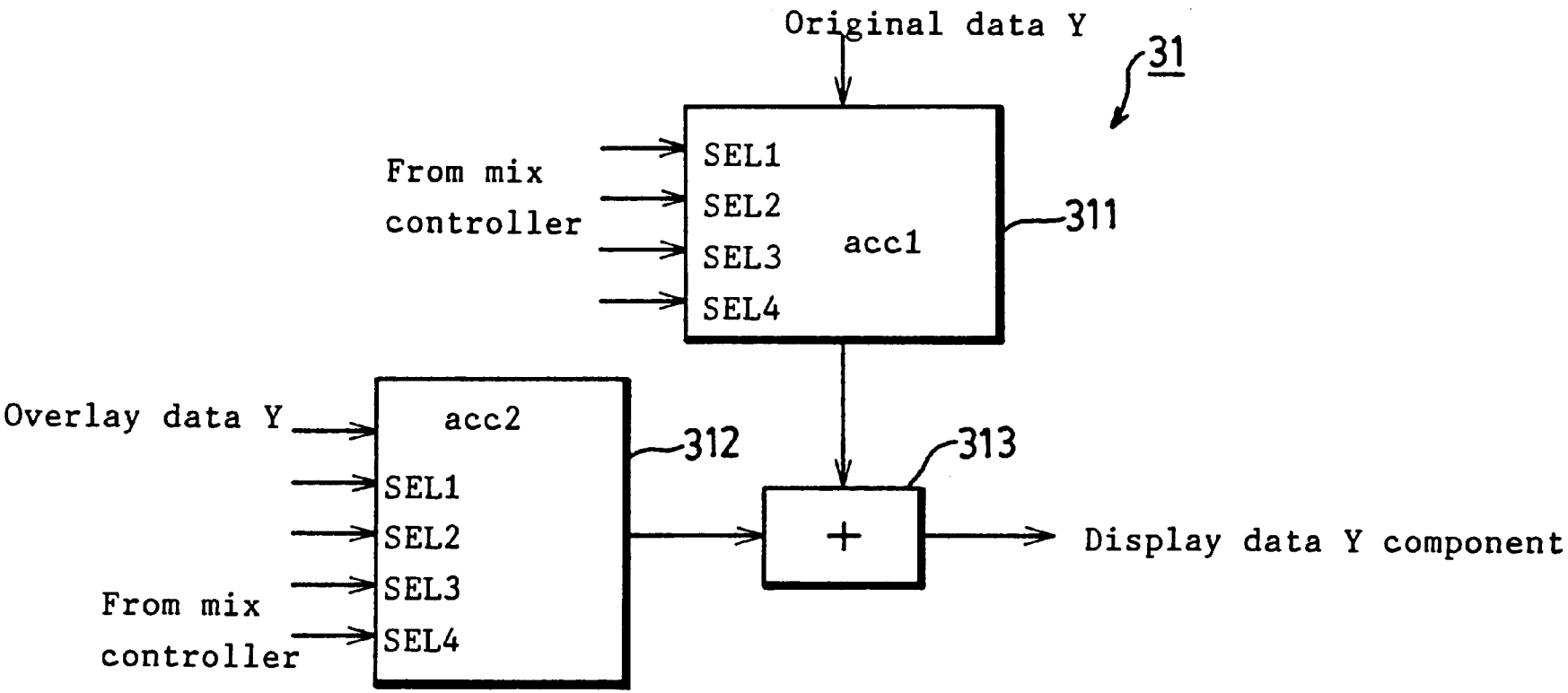
FIG. 12 is a schematic circuit block diagram of a mixer of the mixing unit of the preferred embodiment.

As shown in FIG. 12, the first mixer 31 includes first and second accumulators 311, 312 and an adder 313. The first accumulator 311 receives the luminance component (Y) of the original pixel data, whilst the second accumulator 312 receives the luminance component (Y) of the overlaying pixel data. Each of the first and second accumulators 311, 312 further receives the four select signals SEL1, SEL2, SEL3, SEL4 from a corresponding one of the combinal logic circuits 343 of the mix controller 34 (see FIG. 10). The adder 313 receives the outputs of the first and second accumulators 311, 312 and provides the sum of the inputs thereto to the display. Since the first and second accumulators 311, 312 are identical in construction, only the first accumulator 311 will be described herein.

Figure 13:
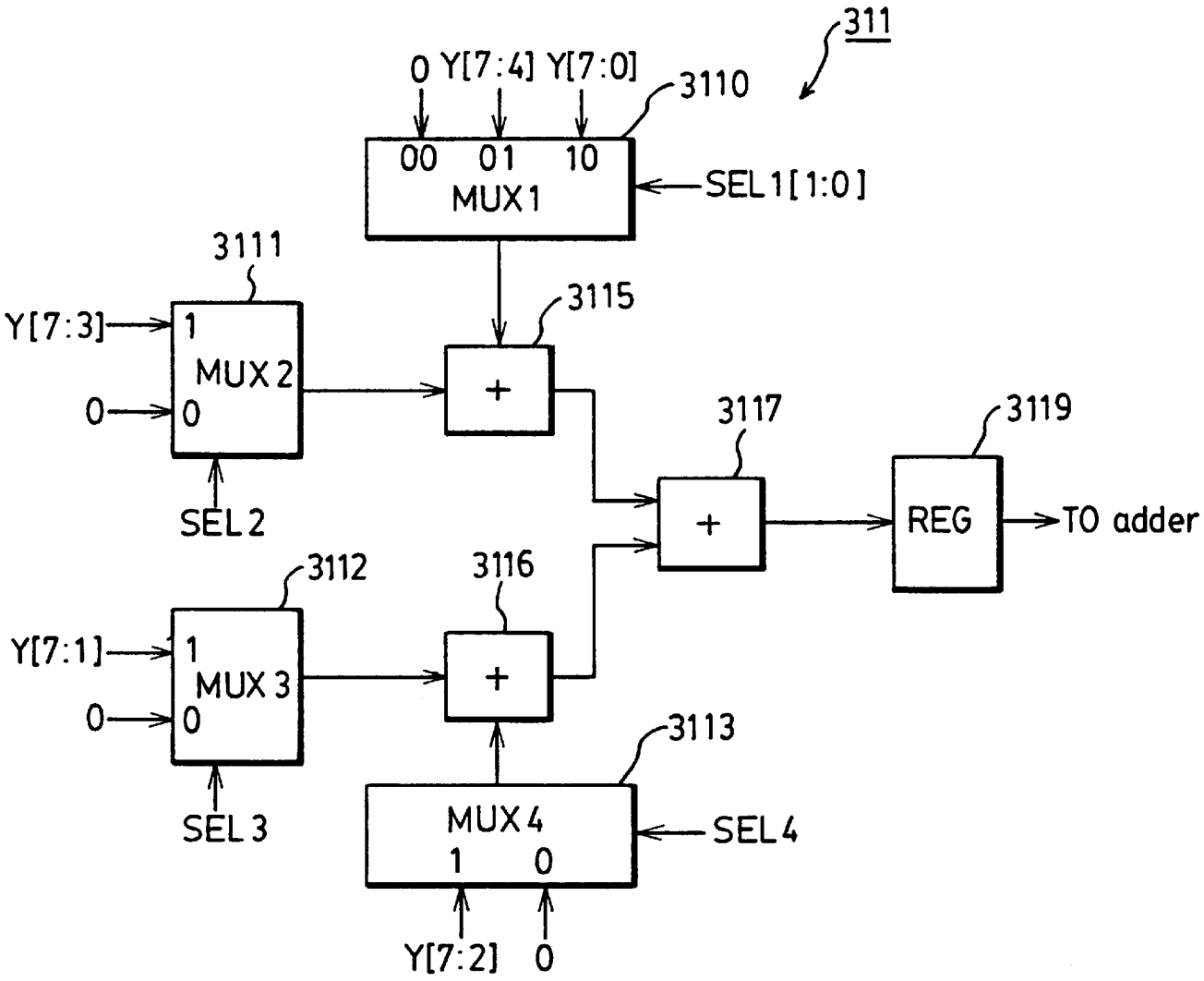
FIG. 13 is a schematic circuit block diagram of an accumulator of the mixer shown in FIG. 12.

As shown in FIG. 13, the first accumulator 311 includes four multiplexers 3110, 3111, 3112, 3113, three adders 3115, 3116, 3117, and a register 3119. The first multiplexer 3110 has a first data input which receives the value of 0, a second data input which receives the first four bits Y[7:4] of the luminance component of the original pixel data or one-sixteenth of the same, and a third data input which receives all eight bits Y[7:0] of the luminance component of the original pixel data. The second multiplexer 3111 has a first data input which receives the first five bits Y[7:3] of the luminance component of the original pixel data or two-sixteenths of the same, and a second data input which receives the value of 0. The third multiplexer 3112 has a first data input which receives the first seven bits Y[7:1] of the luminance component of the original pixel data or eight-sixteenths of the same, and a second data input which receives the value of 0. The fourth multiplexer 3113 has a first data input which receives the first six bits Y[7:2] of the luminance component of the original pixel data or four-sixteenths of the same, and a second data input which receives the value of 0. Each of the multiplexers 3110, 3111, 3112, 3113 further has a control input which receives a respective one of the select signals SEL1, SEL2, SEL3, SEL4. The first adder 3115 receives the outputs of the first and second multiplexers 3110, 3111. The second adder 3116 receives the outputs of the third and fourth multiplexers 3112, 3113. The third adder 3117 receives the outputs of the first and second adders 3115, 3116. The output of the third adder 3117 is received by the register 3119. The output of the register 3119 serves as the output of the first accumulator 311.

It is noted that a mixing ratio ranging from 1/16 to 15/16 can be obtained as a sum of up to four parts, as shown in FIG. 14. Thus, one-sixteenth to fifteen-sixteenths of an 8-bit data can be obtained by selectively adding the first four bits of the 8-bit data (or one-sixteenth of the 8-bit data), the first five bits of the 8-bit data (or two-sixteenths of the 8-bit data), the first six bits of the 8-bit data (or four-sixteenths of the 8-bit data) and the first seven bits of the 8-bit data (or eight-sixteenths of the 8-bit data). Therefore, each of the first and second accumulators 311, 312 is capable of providing the product of the luminance component (Y) of the original pixel data and the second mixing ratio, and the product of the luminance component (Y) of the user-defined overlaying pixel data and the first mixing ratio, respectively.

Referring once more to FIG. 1, the output control unit 4 includes a comparator 41 and a horizontal/vertical counter 42. The comparator 41 receives the starting address (hds), the horizontal width (hdw), the starting address (vds), and the vertical width (vdw) of the user-defined display region from the horizontal and vertical address registers 24, 25 of the data processing unit 2. The comparator 41 then generates an active control signal which is received by the mix controller 34, and an end control signal. The horizontal/vertical counter 42 receives an external horizontal synchronizing clock signal (hsync), an external vertical synchronizing clock signal (vsync), and an external pixel clock signal (pclk).

Figure 15:
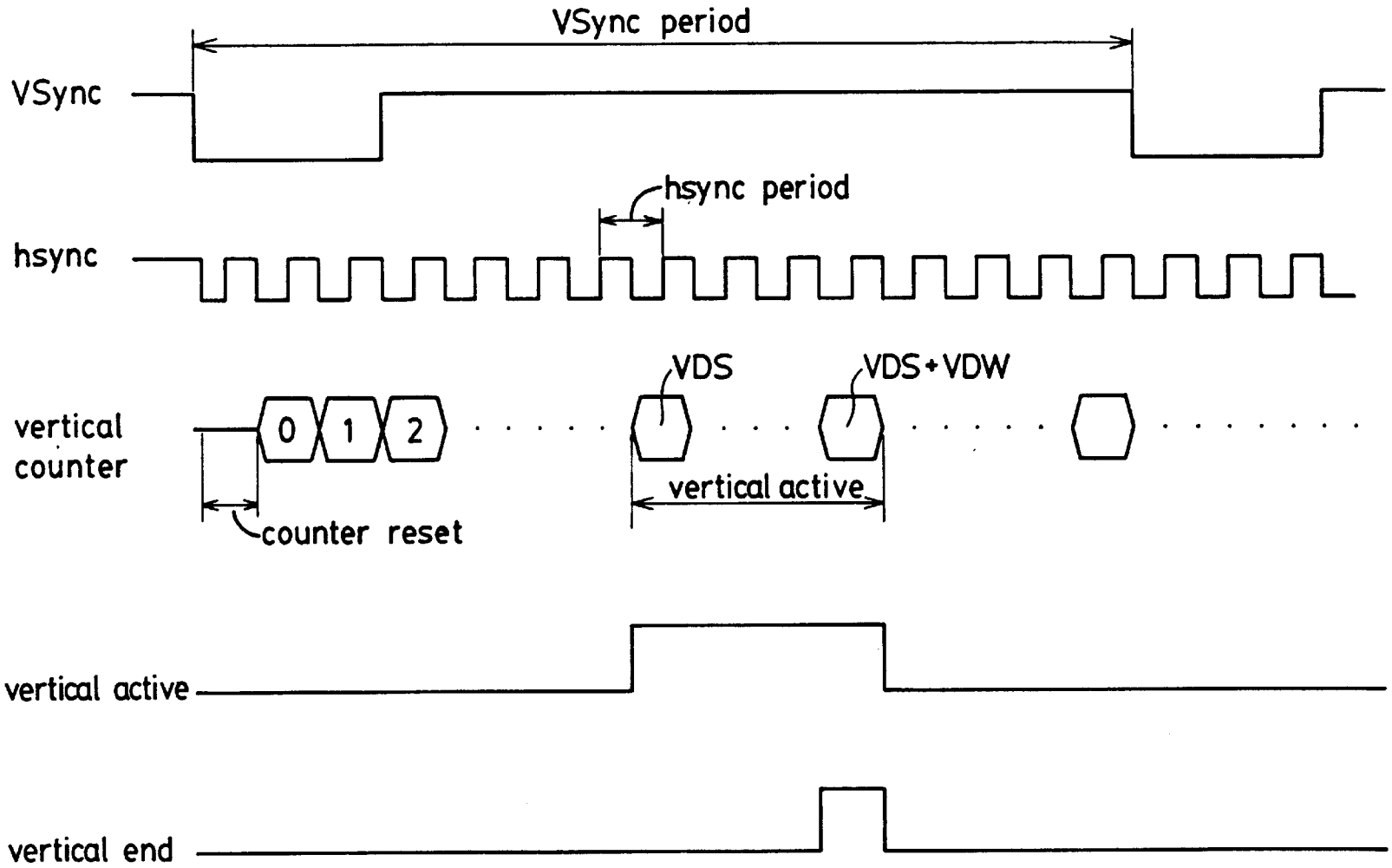
FIG. 15 is a vertical timing diagram of an output control unit of the preferred embodiment.

FIG. 15 is a vertical timing diagram of the output control unit 4. As shown, the comparator 41 generates a vertical active control signal having a duration equal to the vertical width (vdw) of the user-defined display region when the number of hsync clock pulses counted by the counter 42 is equal to the starting address (vds) of the user-defined display region. The comparator 41 further generates a vertical end control signal having a duration equal to one hsync period when the number of hsync clock pulses counted by the counter 42 is equal to the sum of the starting address (vds) of the user-defined display region and the vertical width (vdw) of the latter.

Figure 16:
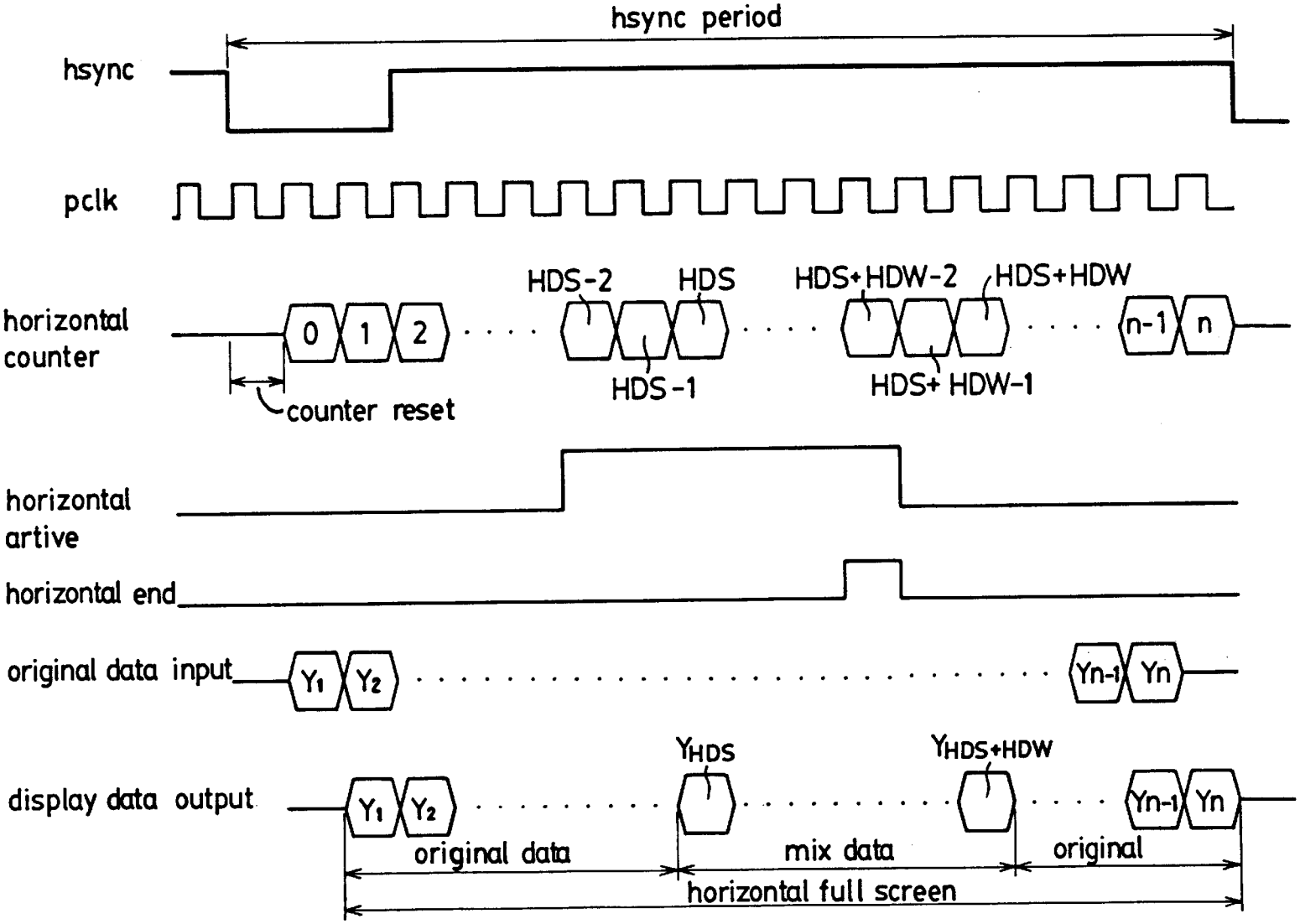
FIG. 16 is a horizontal timing diagram of the output control unit.

FIG. 16 is a horizontal timing diagram of the output control unit 4. As shown, the comparator 41 generates a horizontal active control signal having a duration equal to the horizontal width (hdw) of the user-defined display region when the number of pixel clock (pclk) pulses counted by the counter 42 is equal to the starting address (hds) of the user-defined display region minus two. The subtraction of two units from the starting address (hds) is necessary to ensure proper operation of the on-screen edit/display controller since the overlaying input data requires two pixel clock (pclk) pulses to reach the output of the mixing unit 3, one for reading from the FIFO memory unit 11 and for bitmap conversion, the other one for mixing with the original pixel data by the mixing unit 3. The comparator 41 further generates a horizontal end control signal having a duration equal to one pixel clock (pclk) pulse when the number of pixel clock (pclk) pulses counted by the counter 42 is equal to the sum of the starting address (hds) of the user-defined display region and the horizontal width (hdw) of the latter minus two. The comparator 41 then generates the active control signal when both the vertical active and horizontal active control signals are present, and the end control signal when both the vertical and horizontal end control signals are present. Thus, the active control signal is generated whenever the user-defined region is being scanned, and the end control signal whenever a portion of the display which is outside the user-defined region is being scanned.

Figure 17:
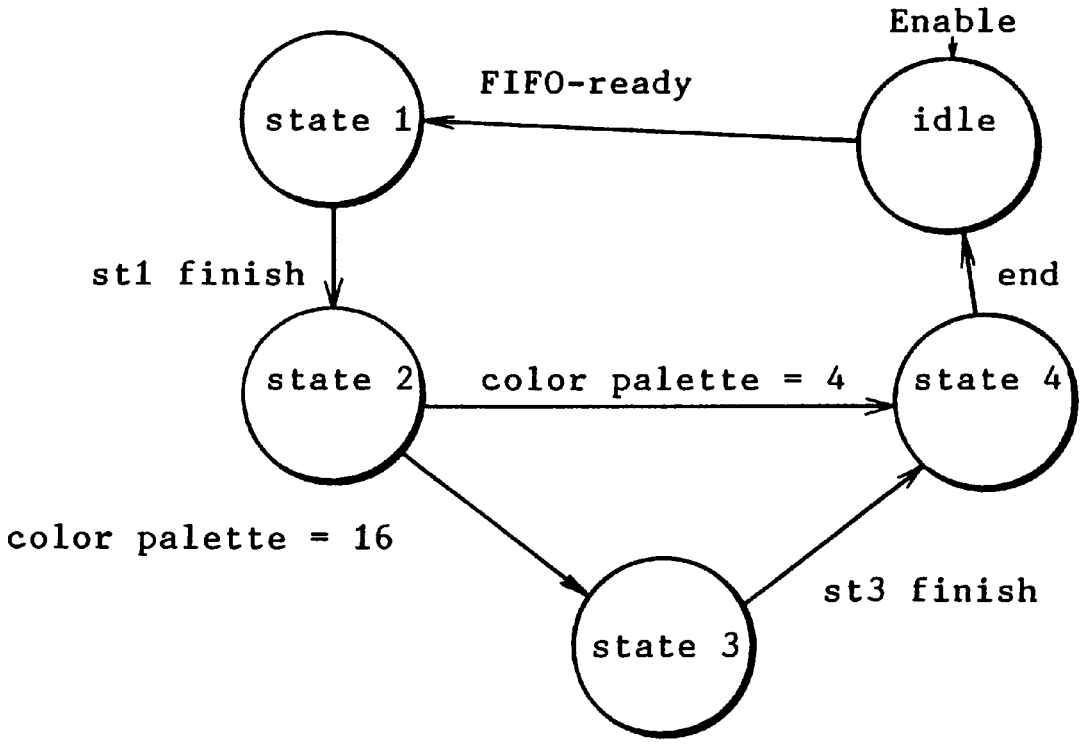
FIG. 17 is a state transition graph of an operation state controller of the preferred embodiment.

Referring again to FIG. 1, the operation state controller 5 is a finite state machine and is used to control the operations of the FIFO memory controller 12 and the data parsing unit 13. The state transition graph of the operation state controller 5 is shown in FIG. 17. Operation of the on-screen edit/display controller of the present invention is initiated whenever the operation state controller 5 is enabled. When the write pointer wt-ptr exceeds the read pointer rd-ptr, the FIFO memory controller 12 generates a FIFO Ready signal to the operation state controller 5 to operate the latter in the first state. At this time, the data parsing unit 13 provides the starting address (hds) and the horizontal width (hdw) to the horizontal address register 24, and the starting address (vds) and the vertical width (vdw) to the vertical address register 25. When operation in the first state is finished, operation in the second state is commenced. At this stage, the data parsing unit 13 provides the mixing weight to the mixing weight register 23, and the first four color palette components to the color map register 22. If there are sixteen available color palette components, the operation state controller 5 operates in a third state, wherein the data parsing unit 13 is controlled so as to provide the remaining twelve color palette components to the color map register 22. If there are only four available color palette components, or after operation in the third state has been completed, operation in the fourth state is initiated. At this time, the operation state controller 5 controls the data parsing unit 13 to provide bitmap data to the bitmap conversion unit 21 whenever the output control unit 4 generates the active control signal. Upon reception of the end control signal from the output control unit 4, the operation state controller 5 returns to the idle state and readies the FIFO memory controller 12 in preparation for the overlaying input data of the next user-defined region.

The operation of the preferred embodiment will now be described briefly in the following paragraphs:

When the operation state controller 5 is enabled, the FIFO memory controller 12 is activated so as to generate the Request signal to an external data source. When data is stored in the FIFO memory 11, the write pointer wt-ptr is incremented, thus causing the write pointer wt-ptr to exceed the read pointer rd-ptr. The FIFO memory controller 12 then generates the FIFO Ready signal to cause the operation state controller 5 to operate in the first state. At this time, the starting address (hds) and the horizontal width (hdw) are stored in the horizontal address register 24, while the starting address (vds) and the vertical width (vdw) are stored in the vertical address register 25. After operation in the first state has been completed, operation in the second state is commenced. At this stage, the mixing weight is stored in the mixing weight register 23, and the first four color palette components are stored in the color map register 22. If there are sixteen available color palette components, the operation state controller 5 operates in the third state so that the remaining twelve color palette components are stored in the color map register 22. Afterwards, the operation state controller 5 operates in the fourth state, wherein the 2-bit or 4-bit bitmap data are provided to the bitmap conversion unit 21 whenever the output control unit 4 generates the active control signal. The bitmap conversion unit 21 then converts the bitmap data into the corresponding color palette component, and provides the luminance and chrominance components (Y, U, V) of the same to the mixers 31, 32, 33, respectively. The mixers 31, 32, 33 further receive the luminance and chrominance components of the original image. The mix controller 34, which receives the mixing weight from the mixing weight register 23, is activated by the output control unit 4, which receives the starting address (hds) and the horizontal width (hdw) from the horizontal address register 24 and the starting address (vds) and the vertical width (vdw) from the vertical address register 25, so as to control in turn the mixers 31, 32, 33 to output the original image when a portion of the display outside the user-defined region is being scanned, and to output the sum of the product of the corresponding one of the luminance and chrominance components of the user-defined image and the first mixing ratio, and the product of the corresponding one of the luminance and chrominance components of the original image and the second mixing ratio when the user-defined display region is being scanned.

When scanning of the user-defined display region has been completed, the output control unit 4 generates the end control signal which is received by the operation state controller 5. At this time, the operation state controller 5 returns to the idle state and readies the FIFO memory controller 12 in preparation for the overlaying input data of the next user-defined region.

It has thus been shown that the on-screen edit/display controller of the present invention permits overlaying of a user-defined image on a user-defined region of a display. The size of the user-defined region can be set so as to occupy the entire display. In addition, the on-screen edit/display controller is capable of mixing the user-defined image and the original image by a mixing ratio ranging from 0 to 1, thereby also permitting replacement of the original image with the user-defined image at the user-defined display region. Moreover, in view of the novel format of the overlaying input data, the overlaying input data has a smaller data size as compared to the prior art. The objects and features of the present invention are thus achieved.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. An on-screen edit/display controller, comprising:

an input unit which is adapted to receive overlaying input data that includes a region header and overlaying image data, the region header defining location and size of a user-defined region of a display, the overlaying image data including mixing weight data and pixel data of a user-defined overlaying image;

a mixing unit, connected electrically to the input unit, which is adapted to receive pixel data of an original image from an external data source and the overlaying image data from the input unit, said mixing unit being operable in a normal mode, wherein said mixing unit outputs the pixel data of the original image, and a mixing mode, wherein said mixing unit outputs the sum of the product of the pixel data of the overlaying image and a first mixing ratio, and the product of the pixel data of the original image and a second mixing ratio, the first mixing ratio corresponding to the mixing weight data and ranging from 0 to 1, the first and second mixing ratios having a sum equal to 1; and an output control unit connected electrically to said input unit and said mixing unit, said output control unit receiving said region header from said input unit and controlling said mixing unit to operate in the normal mode when a portion of the display which is outside the user-defined region is being scanned, and in the mixing mode when the user-defined region is being scanned.

2. The on-screen edit/display controller as claimed in claim 1, wherein said input unit comprises:

a first-in first-out memory for storing the overlaying input data therein;

a memory controller for controlling reading and writing operations of said memory; and a data parsing unit for distributing data from said memory to said mixing unit and said output control unit.

3. The on-screen edit/display controller as claimed in claim 2, wherein the pixel data of the overlaying image includes a color map table having a predetermined number of color palette components, and a plurality of bitmap data, each of which corresponds to one pixel of the overlaying image and indicates the color palette component that corresponds to the respective pixel of the overlaying image.

4. The on-screen edit/display controller as claimed in claim 3, wherein the predetermined number is four, and each of the bitmap data has two data bits.

5. The on-screen edit/display controller as claimed in claim 3, wherein the predetermined number is sixteen, and each of the bitmap data has four data bits.

6. The on-screen edit/display controller as claimed in claim 3, further comprising a data processing unit which interconnects electrically said data parsing unit with said mixing unit and said output control unit, said data processing unit including:

a color map register which receives the color map table from said data parsing unit and which stores the color map table therein;

a bitmap conversion unit which receives the bitmap data from said data parsing unit and which is connected electrically to said color map register, said bitmap conversion unit converting the bitmap data into the corresponding color palette components and providing the corresponding color palette components to said mixing unit;

a mixing weight register which receives the mixing weight data from said data parsing unit and which stores the mixing weight data therein, said mixing weight register providing the mixing weight data to said mixing unit; and a region header register which receives the region header from said data parsing unit and which stores the region header therein, said region header register providing the region header to said output control unit.

7. The on-screen edit/display controller as claimed in claim 6, wherein the region header includes starting address of the user-defined region of the display in a horizontal direction, horizontal width of the user-defined region, starting address of the user-defined region in a vertical direction, and vertical width of the user-defined region.

8. The on-screen edit/display controller as claimed in claim 7, wherein said region header register includes a horizontal address register for storing the starting address of the user-defined region in the horizontal direction and the horizontal width of the user-defined region therein, and a vertical address register for storing the starting address of the user-defined region in the vertical direction and the vertical width of the user-defined region therein.

9. The on-screen edit/display controller as claimed in claim 1, wherein said output control unit includes a horizontal/vertical counter which receives an external horizontal synchronizing clock signal, an external vertical synchronizing clock signal and an external pixel clock signal, and a comparator which is connected electrically to said horizontal/vertical counter and which receives the region header from said input unit and which controls said mixing unit to operate in the normal mode when the portion of the display which is outside the user-defined region is being scanned, and in the mixing mode when the user-defined region is being scanned.

10. The on-screen edit/display controller as claimed in claim 6, further comprising an operation state controller which is connected electrically to said memory controller and said data parsing unit of said input unit and to said output control unit, said operation state controller being activated by said output control unit so as to control in turn said memory controller to commence the reading and writing operations of said memory and so as to further control said data parsing unit to distribute the data from said memory to said data processing unit when the user-defined region is being scanned, said operation state controller being deactivated by said output control unit when the portion of the display which is outside the user-defined region is being scanned.

11. The on-screen edit/display controller as claimed in claim 10, wherein said operation state controller is a finite state machine.

12. The on-screen edit/display controller as claimed in claim 6, wherein each of the color palette components and the pixel data of the original image includes a luminance component (Y) and chrominance components (U, V).

13. The on-screen edit/display controller as claimed in claim 12, wherein each of the luminance component (Y) and the chrominance components (U, V) has 8 data bits.

14. The on-screen edit/display controller as claimed in claim 12, wherein said mixing unit comprises:

a first mixer for mixing the luminance components (Y) of the color palette component and the pixel data of the original image;

a second mixer for mixing the chrominance components (U) of the color palette component and the pixel data of the original image; and a third mixer for mixing the chrominance components (V) of the color palette component and the pixel data of the original image.

15. The on-screen edit/display controller as claimed in claim 14, wherein said mixing unit further comprises a mix controller which receives the mixing weight data from said mixing weight register and which is connected electrically to said first, second and third mixers and to said output control unit, said mix controller being activated by said output control unit to control mixing of the pixel data of the original image and the color palette components by said first, second and third mixers when the user-defined region is being scanned, said mix controller being further activated by said output control unit to control in turn said first, second and third mixers to output the pixel data of the original image when the portion of the display outside the user-defined region is being scanned.

* * * * *